US007556560B2

(12) United States Patent
Janesky

(10) Patent No.: US 7,556,560 B2
(45) Date of Patent: Jul. 7, 2009

(54) CRAWLSPACE FOUNDATION VENT COVERS

(76) Inventor: Lawrence M. Janesky, 60 Silvermine Rd., Seymour, CT (US) 06483

( * ) Notice: Subject to any disclaimer, the term of this patent is extended or adjusted under 35 U.S.C. 154(b) by 0 days.

(21) Appl. No.: 10/785,303

(22) Filed: Feb. 24, 2004

(65) Prior Publication Data

US 2005/0186900 A1 Aug. 25, 2005

(51) Int. Cl.
*F24F 13/06* (2006.01)

(52) U.S. Cl. ..... 454/276; 454/270; 454/275

(58) Field of Classification Search ..... 454/259, 454/260, 270, 271, 275, 276; 49/463; 52/202
See application file for complete search history.

(56) References Cited

U.S. PATENT DOCUMENTS

| | | | | | |
|---|---|---|---|---|---|
| 978,718 | A * | 12/1910 | Ellington | 126/319 |
| 1,274,996 | A * | 8/1918 | Davis | 454/322 |
| 2,821,895 | A * | 2/1958 | Allabaugh | 454/276 |
| 2,834,278 | A * | 5/1958 | Crute, Jr. | 454/276 |
| 3,130,659 | A * | 4/1964 | Compton et al. | 454/276 |
| 3,530,781 | A * | 9/1970 | Kesinger | 454/275 |
| 3,975,870 | A * | 8/1976 | Naka | 52/20 |
| 4,026,082 | A * | 5/1977 | Crofoot | 52/302.7 |
| 4,502,368 | A * | 3/1985 | Hempel | 454/277 |
| 5,125,197 | A * | 6/1992 | Fuchs | 52/202 |
| 6,014,841 | A * | 1/2000 | McCoy et al. | 52/19 |
| 6,601,356 | B2 * | 8/2003 | Snyder | 52/302.1 |

* cited by examiner

*Primary Examiner*—Gregory A Wilson
(74) *Attorney, Agent, or Firm*—Perman & Green, LLP

(57) ABSTRACT

Air vent covers for attachment to crawlspace walls, over or into air vent openings, to enclose the air vent openings and seal them against the entry of air and humidity from the atmosphere into the crawlspace. The preferred air vent covers comprises rectangular panels molded from durable plastic composition, with a flat outer surface surrounded by a recessed peripheral border provided with holes for receiving attachment means for fastening the cover to a crawlspace wall. The preferred rectangular panels are also molded with a recessed inner surface surrounded by a projecting peripheral border, and the recessed inner surface is provided with projecting reinforcing ribs which extend across the width of the panels to reinforce the panels against warpage when they are fastened to the crawlspace wall. Alternatively, the vent covers may be hollow tubular elements of durable plastic sized to be frictionally-engaged within an air vent opening in place of an air vent to seal the crawlspace wall.

5 Claims, 4 Drawing Sheets

CRAWLSPACE FOUNDATION VENT COVERS

BACKGROUND OF THE INVENTION

1. Field of the Invention

The present invention relates to novel and efficient vent covers for preventing the entry of moisture into so-called crawlspaces of buildings such as homes. Moisture is very damaging to wood structural support members of buildings and is absorbed by such members from the ground and from moist air in contact therewith.

Many buildings and homes are built without basements, and are elevated a few feet above the ground on support members such as stone, poured concrete or concrete block walls. In many cases the crawlspace between the ground surface and the wooden floor beams or joists of the house is at a level below the level of the surrounding soil, or below the level of saturated soils in wet weather, so that water flows into and is absorbed up through the floor of the crawlspace, usually a dirt surface, from adjacent ground areas of higher elevation and up from the sub-soil. Such water is drawn into the headroom of the crawl space in the form of water vapor and penetrates the wooden structural members of the building, causing wood rot, mold, odors, attraction of ants and other insects, rodents etc. Also, the escape of dangerous radon gas from the ground into the crawlspace and into the building is another problem.

Even in crawlspaces that do not leak or flood from groundwater, the earth below the crawlspace, and forming the floor of the crawlspace, has a high humidity level most of the time, and this water vapor rises into the crawlspace to produce a humid air atmosphere within the crawlspace, which moves upwardly to penetrate the structural framing and living spaces above the crawlspace.

Mold spores exist in air and grow into destructive mold in the presence of damp organic material, such as moist wood. Humidity levels of from 50% to 90% are common in crawlspaces, even those that have never flooded. Mold can grow on dirt, insulation, wood framing and even under carpeting on the floor within the home. Mold digests and destroys organic materials as it feeds on them. Damp environments also provide an inviting environment for insects such as termites, ants and similar critters which feed on moist organic material such as structural support wood and can contribute to the destruction and collapse thereof.

2. State of the Art

In an effort to prevent the penetration of water and water vapor into building crawlspaces it has been proposed to apply a continuous moisture barrier layer such as a thick plastic film over the dirt floor of the crawlspace. This has been proven to be unsatisfactory, per se, since water is drawn up from the ground, beneath the barrier, and leaks and/or vaporizes around the edges of the barrier into the crawlspace environment. Also, water vapor penetrates the walls of the crawlspace and/or otherwise enters the crawlspace and accumulates on top of the vapor barrier film and generates moisture which permeates into the wooden structural supports of the building resulting in rot and decay, mold and fungus, odors and vermin.

U.S. Pat. No. 5,642,967 discloses a system in which the barrier film is associated with an excavated pit filled with aggregate.

Water entering the crawlspace collects in the pit and is pumped from a sump when necessary. A vapor barrier film is applied over the dirt floor of the crawlspace, and over the pit and sump areas, to prevent moisture from entering the building. Such a system is unsatisfactory because it has no means for preventing the entry of ground water or water vapor and its accumulation on the surface of the barrier film, with the disadvantages discussed supra.

U.S. Pat. No. 6,575,666 discloses a system for waterproofing a crawlspace against the entry of sub-soil water vapor and also against the entry of external ground water and water vapor through the crawlspace walls to completely isolate the building from water vapor from the earth. The system of U.S. Pat. No. 6,575,666 comprises applying over the floor of the crawlspace, generally a dirt floor but sometimes a poured concrete floor, a continuous sealed plastic film barrier layer, and extending the barrier film vertically-upwardly to the tops of the walls to cover and seal the interior peripheral walls enclosing the crawlspace. This encapsulates the entire crawlspace against the penetration of external ground water or flood water, sub-soil water and water vapor onto the surface of the plastic barrier film and into the crawlspace atmosphere. According to U.S. Pat. No. 5,642,967, and in most crawlspace enclosures, the walls enclosing the crawlspace are provided with air-circulation vents which permit the entry of exterior air into the crawlspace to displace the humid atmosphere therewithin. In some cases the vents are temperature-controlled to open automatically when the exterior temperature is about 70° F. and to close gradually as the temperature drops to about 40° F. However, it has been found that air-circulation vents are unnecessary and disadvantageous in crawlspace enclosures, particularly those which have been waterproofed and moistureproofed, such as according to U.S. Pat. No. 6,575,666. This is because such vents let cold air enter in the winter and thus waste energy, and let hot humid air enter in the summer, which is cooled in the crawlspace and causes condensation, which makes the moisture problem in the crawlspace worse, not better. The manual or automatic closure vent vanes are ineffective for sealing the vents against the entry of moist air, thereby representing a breach of the encapsulation system. Removal of the vents and replacement with 8"×16" cement blocks is difficult and time-consuming. Therefore there is a need for a means for sealing vents in the walls of a crawlspace enclosure to prevent the entry of unconditioned exterior air into the crawlspace, particularly in the case of otherwise encapsulated or sealed crawlspaces.

SUMMARY OF THE INVENTION

The present invention relates to novel vent covers for attachment to crawlspace walls, over air vent openings, to seal the air vent openings against the passage of air, through the vent opening and into the crawlspace atmosphere. The invention relates particularly to such vent covers for use over vent openings on walls of crawlspaces which have been encapsulated to exclude the entry of water and water vapor from the crawlspace.

The present vent covers are water-impervious, water-resistant, rigid plastic panels which are reinforced against warpage along their width or major axis and which are provided with a sealing means around their inner periphery or marginal area, preferably an adhesive-backed plastic foam insulation tape which seats against the outer surface of the crawlspace wall to cover and enclose a vent on the wall and seal it against the entry of outside air and humidity.

The present panels are provided with fastener holes, at least at the side edges thereof, adjacent the outer periphery, to enable each panel to be secured to the wall, such as by means of suitable screws or nails or other fasteners.

The foregoing aspects, advantages and features of the present invention are explained in the following description including the accompanying drawings.

DETAILED DESCRIPTION

Figure 1:
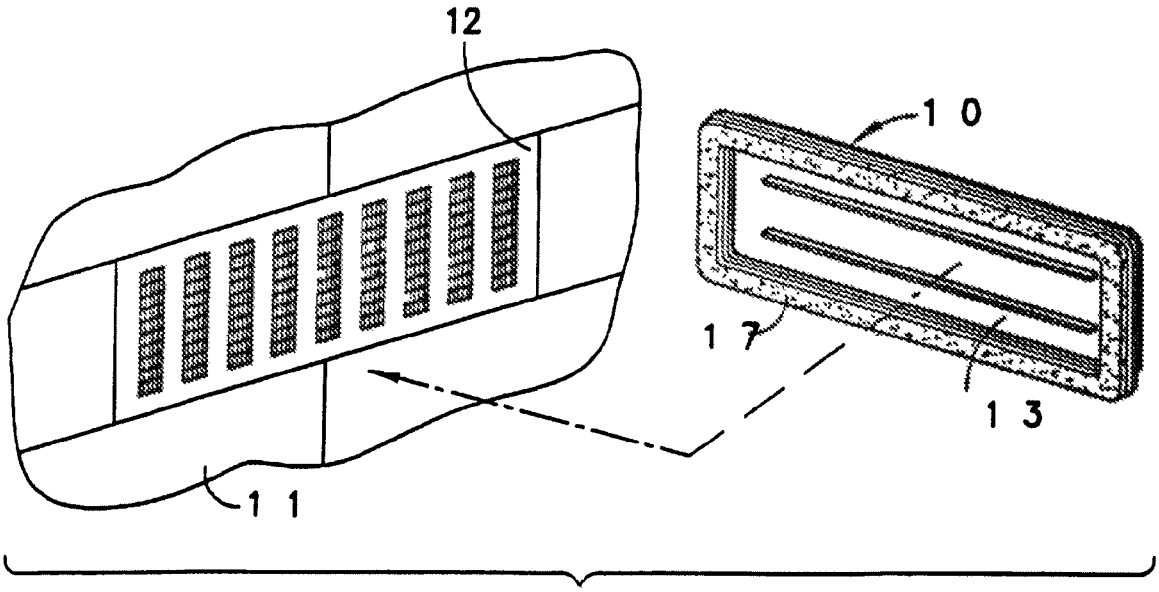
FIG. 1 is a perspective view of the rear surface of a vent cover and the outer surface of a crawlspace wall having an air vent mounted therein.
Figure 2:
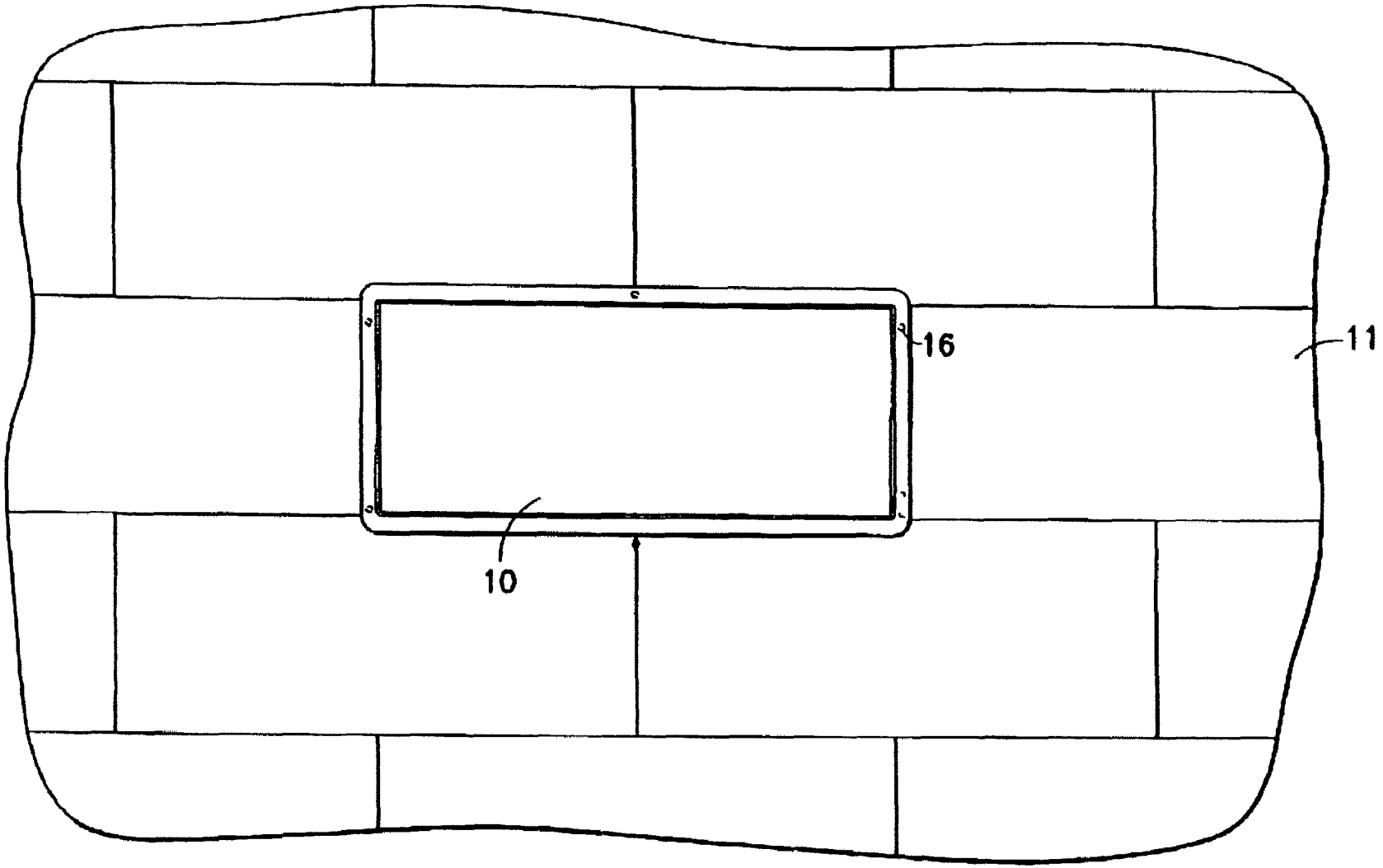
FIG. 2 is a perspective view of the outer surface of the vent cover of FIG. 1 fastened to the crawlspace wall over the air vent.
Figure 3:
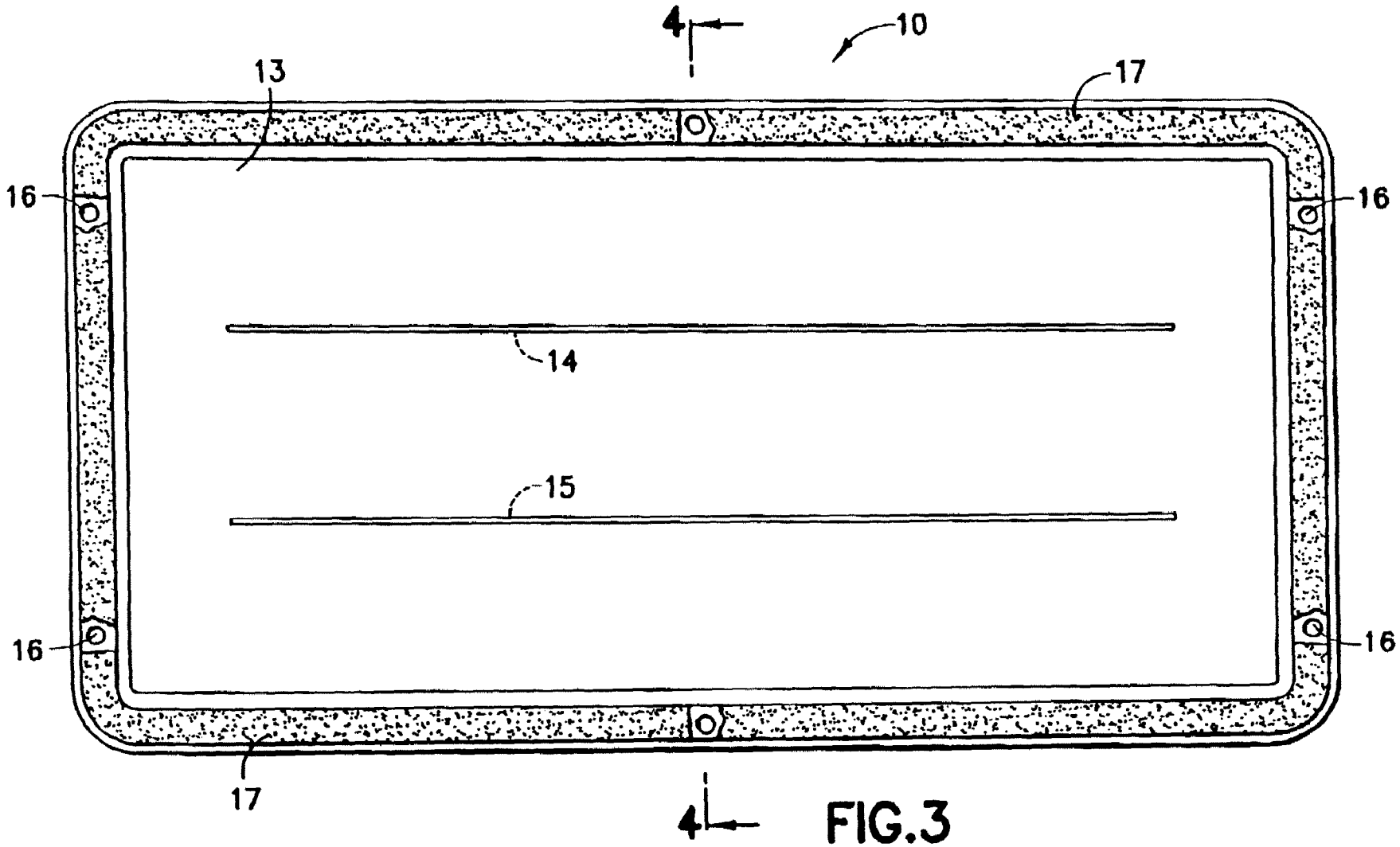
FIG. 3 is a plan view of the rear surface of the vent cover shown in FIGS. 1 and 2.
Figure 4:
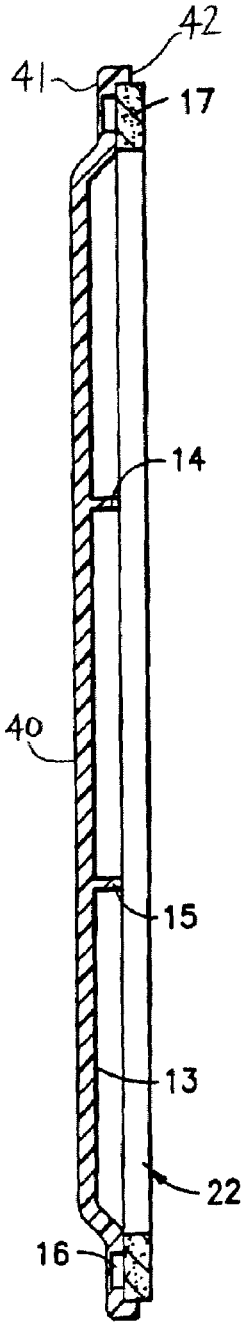
FIG. 4 is a cross-sectional view of the vent cover of FIG. 3, taken along the line 4-4 thereof.

Referring to the embodiment of FIGS. 1 and 2, the present vent covers 10 are sized to be larger in height and width to cover and enclose a conventional air vent 12 which corresponds in size to a concrete block 11 so as to be insertable in a cement block wall in place of one of the concrete blocks. Thus, concrete blocks 11 are 8" tall and 16" wide, as are conventional air vents 12, and the present air vent covers 10 are at least slightly larger in height and width, such as 10" in height and 19" in width, so as to fully surround and seal the air vent 12 which is retained in the wall.

The present vent covers 10 preferably are molded from strong, rigid plastic composition such as 20% talc-filled ployprpylene. The vent covers 10 have an integral flat outer surface 40 that is recessed outwardly around the periphery to form an integral recessed peripheral border 41 for strength, and are provided with a spaced pair of rear ribs 14, 15 which extend lengthwise across the recessed rear or inner surface 13 of the vent cover 10. The recessed rear surface 13 is surrounded by an integral projecting peripheral border 42 where the ribs 14, 15 project from recessed rear surface 13 a distance of about 0.25 inch, the extent of the recess, and are spaced from each other and from the edges of the recess by about 3" to impart rigidity and strength to the covers 10. The side edges of the covers 10 are provided with fastener holes 16 to receive screws, bolts or other fasteners for attaching the vent covers 10 to a crawlspace wall to enclose and seal an air vent 12.

Preferably each cover 10 is provided with a sealing means 17 around the outer periphery or border of the rear surface 13 for sealing engagement with the crawlspace wall and with the concrete blocks 11 surrounding the air vent 12 being sealed. A preferred sealing means 17 is a narrow plastic foam insulating tape having an adhesive surface for sticking the tape to the peripheral border at the rear surface 13 of the sealing vent cover 10. When the vent cover is being fastened to the wall, the fasteners pass through the holes 16 and through the insulating tape 17, and the plastic foam insulation is compressed against the cement block surface to provide a good seal against air and humidity passage. Another sealing means is a bead of conventional caulk composition.

It will be clear to those skilled in the art that the dimensions of the present vent covers 10 may be varied for different uses where the dimensions of the opening or air vent in a wall differ from 8"×16", and that the present vent covers 10 may be molded in any desired color.

Figure 5:
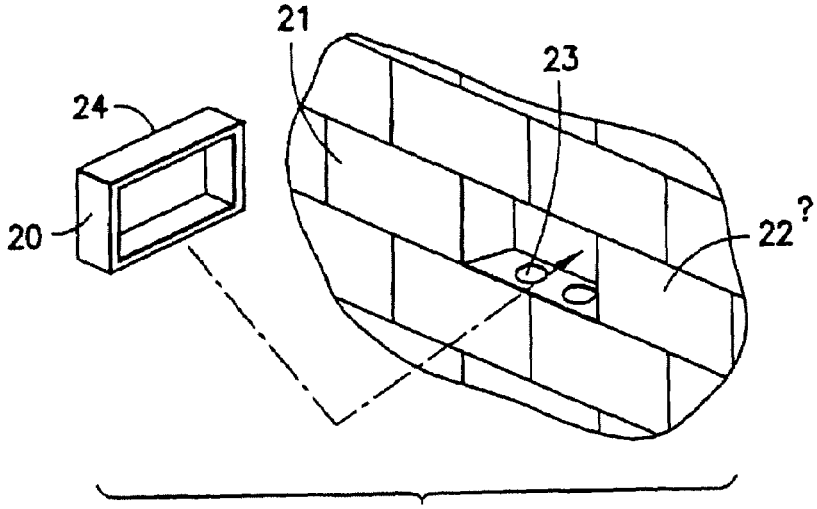
FIG. 5 is a perspective view of the rear open side of a tubular vent cover element ready for insertion as a vent space cover in a crawlspace wall, according to another embodiment of the invention.
Figure 6:
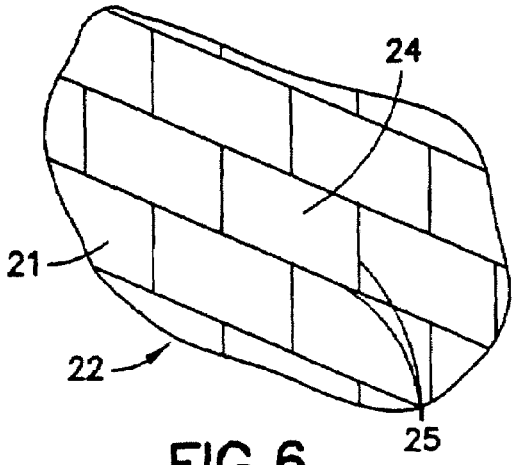
FIG. 6 is a perspective view of the crawlspace wall of FIG. 5 with the tubular vent cover element inserted therein and sealed in position.

FIGS. 5 and 6 illustrate another embodiment of the present invention in which the vent covers are rectangular tubular or hollow elements 20 corresponding in size or dimensions to the size of conventional concrete blocks 21 of a crawlspace wall 22.

In FIG. 5 an air vent 12 of dimensions similar to a concrete block 21, as shown in FIG. 1, has been removed, leaving an open space 23. Instead of filling the open space with another concrete block, which is heavy and which requires the preparation of mortar and its application all around the new block, the present embodiment provides a novel, lightweight molded plastic plug element 24 which can be punched into the crawlspace wall to fill the open space 23 in simple manner.

The plug or fill element 20 is a hollow or tubular rectangular block element molded of lightweight durable plastic composition and having dimensions similar to a conventional concrete block, i.e., 8" tall and 16" long. The width of the element 20 can be 8" but only needs to be sufficient to enable the element to be frictionally-retained in the wall 22 after it is forced in to fill the open space 23, i.e., a thickness or width 2" or 4" is generally sufficient. The element 20 is forced in to the wall 22 so that its outer surface 24 is flush or co-planar with the outer surface of the wall 22 as shown in FIG. 6. The fill or plug element 20 has a front panel or co-planar with the outer surface of the wall 22 as shown in FIG. 6. The fill or plug element 20 has a front panel or surface 24 which is impervious to air and dampness so as to provide a moisture barrier which encloses the previously-open wall space 23. The opposed rear surface of the element 20 may be open and the other surfaces may be covered, as shown in FIG. 5.

The plug or fill element 20 preferably is sealed to the wall 22 after its insertion by applying a continuous bead 25 of suitable caulking composition around the periphery of the front panel 24 and its interface with the crawlspace wall 22 in order to provide an air-impervious seal therebetween. The front panel 24 of the element can be painted or textured to match the appearance of the concrete blocks 21.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

The invention claimed is:

1. An air vent cover for attachment to a crawlspace wall, over an air vent opening, to enclose said air vent opening and seal the air vent opening against the entry of air and humidity from the atmosphere into the crawlspace, said air vent cover comprising:

a rectangular panel of unitary construction molded from durable plastic composition with an integral flat outer surface surrounded by an integral recessed peripheral border, the recessed peripheral border being recessed relative to the flat outer surface and being provided with a plurality of holes for receiving attachment means for fastening the cover to a crawlspace wall; and an integral recessed inner surface surrounded by an integral projecting peripheral border, said recessed inner surface being recessed relative to the projecting peripheral border and being provided with integral projecting reinforcing ribs which extend across the width of the recessed inner surface and project from the integral recessed inner surface inwards towards the integral projecting peripheral border to reinforce the panels against warpage when they are fastened to the crawlspace wall.

2. The air vent cover according to claim 1 further comprising a sealing means bonded to the projecting peripheral border surrounding the recessed inner surface for providing a continuous seal between the border of the vent cover and the surface of a crawlspace wall to which the vent cover is fastened.

3. The air vent cover according to claim 2 in which the sealing means comprises a narrow plastic foam insulating tape adhered to the peripheral border of the vent cover.

4. The air vent cover according to claim 1 in which said reinforcing ribs project inwardly from the integral recessed inner surface of said cover so that the integral projecting reinforcing ribs are substantially flush with the integral projecting peripheral border surrounding the integral recessed inner surface.

5. The air vent cover according to claim 4 comprising a pair of reinforcing ribs spaced from each other by a distance of about 3".

* * * * *